US006158578A

United States Patent [19]

Greiner

[11] Patent Number: 6,158,578

[45] **Date of Patent: *Dec. 12, 2000**

[54] JEWELRY HOLDER WITH AT LEAST TWO MOVABLE AND INTERCHANGEABLE STANDS

[76] Inventor: Lori Greiner, 1430 N. Astor St., Chicago, Ill. 60610

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/884,744

[22] Filed: Jun. 30, 1997

Related U.S. Application Data

[63] Continuation-in-part of application No. 08/665,734, Jun. 14, 1996, Pat. No. 5,762,184.

[51] Int. Cl.[7] ..... A47B 81/00

[52] U.S. Cl. ..... 206/6.1; 211/85.2; 312/107

[58] Field of Search ..... 206/6.1, 303, 566, 206/738; 211/85.2, 119.005, 189, 59.1; 312/107, 108, 140.4, 234, 237, 280; 52/710; 24/162

[56] References Cited

U.S. PATENT DOCUMENTS

| | | | |
|---|---|---|---|
| 128,943 | 7/1872 | Bisel . | |
| D. 194,466 | 1/1963 | Johnson . | |
| D. 197,252 | 12/1963 | Spears . | |
| 201,656 | 3/1878 | Dunn | 211/59.1 |
| D. 277,340 | 1/1985 | Christen . | |
| D. 303,999 | 10/1989 | Hansson . | |
| D. 315,460 | 3/1991 | Sorce, Jr. . | |
| 381,016 | 4/1888 | Hollyday . | |
| 540,206 | 5/1895 | Brooks . | |
| 727,564 | 5/1903 | Macey | 312/107 |
| 948,377 | 2/1910 | Prouty . | |
| 2,470,993 | 5/1949 | Kramer | 206/6.1 |
| 2,559,289 | 7/1951 | Eisen et al. . | |
| 2,670,085 | 2/1954 | Sorrentino | 211/59.1 |
| 2,714,443 | 8/1955 | Kuvin . | |
| 2,760,647 | 8/1956 | Saul, Jr. . | |
| 3,082,492 | 3/1963 | Grubb | 403/381 |
| 3,351,401 | 11/1967 | Cohen . | |
| 3,406,821 | 10/1968 | Weissberg . | |
| 3,589,525 | 6/1971 | Allen | 52/710 |
| 3,606,007 | 9/1971 | Huston . | |
| 3,847,458 | 11/1974 | Nowak . | |
| 4,088,380 | 5/1978 | Watts . | |
| 4,116,509 | 9/1978 | Smith . | |

(List continued on next page.)

FOREIGN PATENT DOCUMENTS 411236 6/1934 United Kingdom .

OTHER PUBLICATIONS

Advertisement from "Home Organization," pp. 33–36 (date unknown).
Advertisement, "Ear–It–Is!," two pages (date unknown).
Advertisement, "Jewelry Rack," from Paragon Catalog Exclusive, one page (date known).
Advertisement, "Celestial Organizer," one page (date known).
Advertisement, "Heirloom Cherry' Jewelry Armoire," one page (date unknown).
Advertisement showing 6 jewelry boxes, one page (date known).
Hand drawing of a Jewelry Box, one page (date known).

*Primary Examiner*—Jim Foster
*Attorney, Agent, or Firm*—Merchant & Gould P.C.

[57] ABSTRACT

A jewelry holder with at least two movable and interchangeable stands and a base. The base may be in the form of a box with a slidable drawer in which a ring holder platform may be inserted. The base has a plurality of grooves to receive jewelry stands. The jewelry stands have various configurations to hold earrings, necklaces and bracelets.

46 Claims, 5 Drawing Sheets

U.S. PATENT DOCUMENTS

| | | | |
|---|---|---|---|
| 4,341,300 | 7/1982 | Roy | 206/6.1 |
| 4,396,121 | 8/1983 | Lemmon . | |
| 4,420,084 | 12/1983 | Whelan . | |
| 4,746,009 | 5/1988 | Liberman . | |
| 4,775,053 | 10/1988 | Geiger . | |
| 4,811,996 | 3/1989 | Hansson . | |
| 4,819,814 | 4/1989 | Fogelgren . | |
| 4,848,585 | 7/1989 | Snyder . | |
| 5,067,617 | 11/1991 | Caldwell et al. . | |
| 5,117,971 | 6/1992 | Fisher . | |
| 5,253,790 | 10/1993 | Brady | 211/59.1 |
| 5,649,625 | 7/1997 | Ovadia | 206/6.1 |
| 5,779,056 | 7/1998 | Russell et al. | 206/709 |

JEWELRY HOLDER WITH AT LEAST TWO MOVABLE AND INTERCHANGEABLE STANDS

The present application is a continuation-in-part of U.S. Ser. No. 08/665,734 filed Jun. 14, 1996, U.S. Pat. Ser. No. 5,762,184.

BACKGROUND OF THE INVENTION

The present invention relates to a jewelry holder with at least two movable and interchangeable stands. While several different kinds of jewelry holders are known, there is a need for a jewelry holder that is simple to manufacture yet provides easy access to the jewelry.

One type of jewelry holder is in the form of a container with relatively high side and back walls and a top that is hinged to the back wall to permit access into the container. Earring stands are fixed to the bottom of the container. A particular problem with this type of earring holder is that it is very difficult to insert and remove the jewelry from the stands because the side walls and hinged top limit the amount of space available.

To solve that problem, it has been proposed to provide an earring rack on a base. The rack has legs that fit within holes provided in the base. A particular disadvantage to this type of jewelry holder is that the stand, if removed from the base, cannot be placed on a table, dresser top, or similar horizontal surface without falling over.

Yet another type of jewelry holder proposes racks that slide into a box-like container having a single open side. Again, a problem with this type of jewelry holder is that because the racks are designed as an integral part of the box-like container when the racks are removed from the container, the rack cannot be placed on a horizontal surface without failing over. In addition, because there is only one open side, access to the jewelry is difficult.

SUMMARY OF THE INVENTION

According to a first aspect of the invention there is provided a jewelry holder having a first base having a first groove and a second groove, a first stand and a second stand removably located on the base. The first and second stands have a bottom member that is slidably receivable in either the first groove or the second groove and the bottom member is configured to allow the first and second stands to be self-supporting when removed from the base.

According to a second aspect of the invention there is provided a jewelry holder having a box, a first stand and second stand. The box has a top spaced from a bottom, the top having at least a first and a second groove to slidably receive a first and a second stand, a first side wall opposite and spaced from a second side wall, and a front opposite and spaced from a rear wall such that the rear wall is substantially normal to the first and second side walls and the front defines an opening to slidably receive a drawer. The first and second stands are removably located on the base. The first and second stands have a bottom member that is slidably receivable in either the first groove or the second groove and is configured to allow the first and second stands to be self-supporting when removed from the base.

According to a third aspect of the invention there is provided a ring holder having a platform and a plurality of mounds integrally formed on the platform. The plurality of mounds have a shape that allow rings to be mounted thereon.

According to a fourth aspect of the invention there is provided a jewelry holder having a first box, a drawer and a ring holder. The first box has a top spaced from a bottom, a first side wall opposite and spaced from a second side wall, and a front opposite and spaced from a rear wall such that the rear wall is substantially normal to the first and second side walls and the front defines an opening to slidably receive a drawer. The drawer is slidably received in the opening of the box. The ring holder has a platform and a plurality of mounds integrally formed on the platform. The plurality of mounds have a shape that allows rings to be mounted thereon.

DETAILED DESCRIPTION OF THE INVENTION AND PREFERRED EMBODIMENTS

Figure 1:
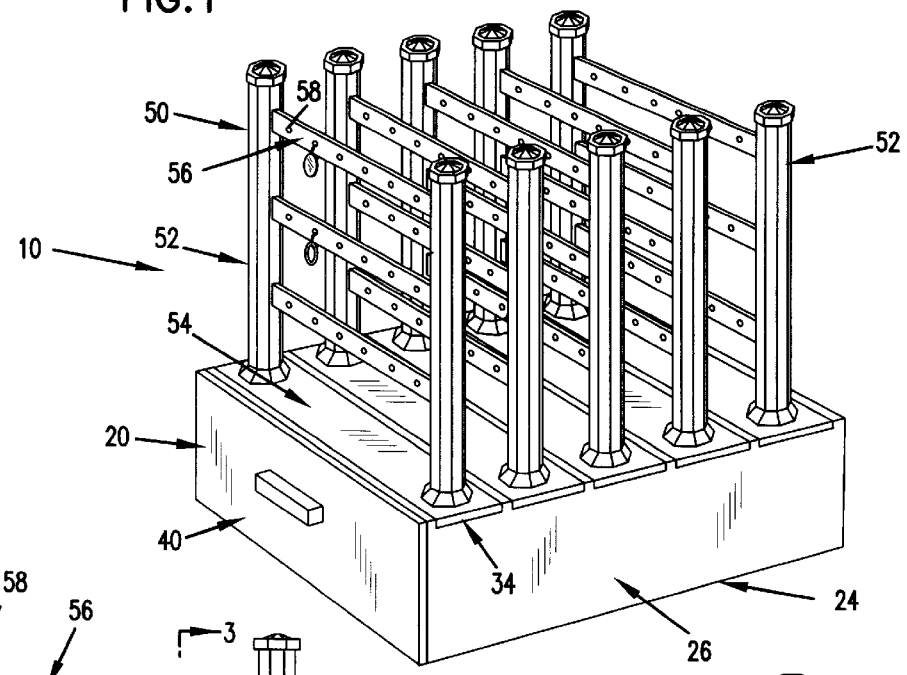
FIG. 1 is a perspective view of the preferred embodiment of the jewelry holder with at least one movable stand of the present invention.

In accordance with a preferred embodiment, the jewelry holder with at least one movable stand 10 includes a base 20 and at least one stand 50. The stand has at least one crosspiece 56 with at least one aperture 58 that can slidably receive a post or stem of an earring. In addition, the stand 50 can be removed from the base 20 to permit the earrings to be easily viewed and accessed.

Figure 2:
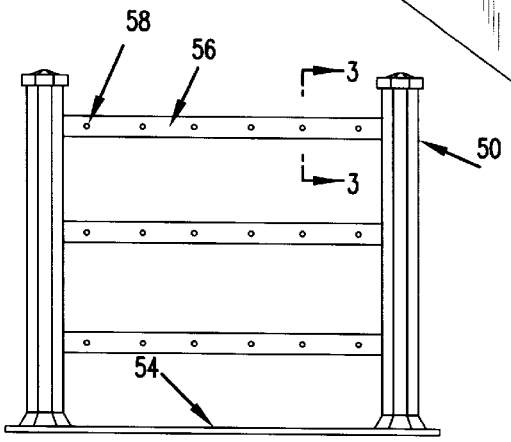
FIG. 2 is a front view of a stand that has been removed from the base of the jewelry holder of FIG. 1.
Figure 3:
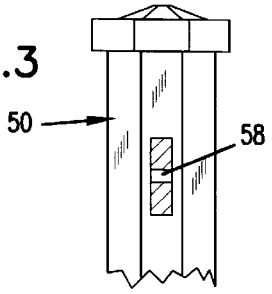
FIG. 3 is a cross-sectional view of a portion of the stand shown in FIG. 2 taken along line 3—3.
Figure 4:
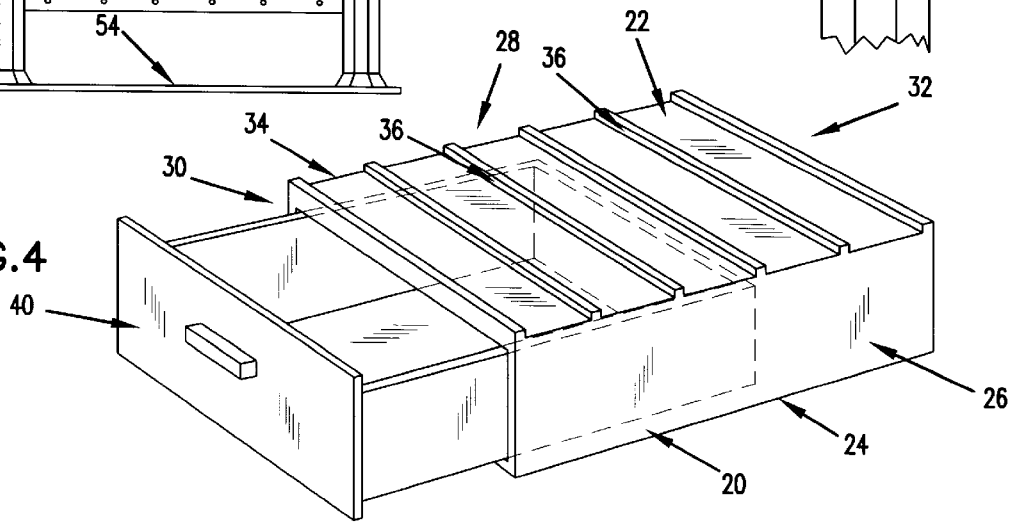
FIG. 4 is a perspective view of the base of the jewelry holder of FIG. 1 with each of the stands removed and the drawer partially open.

Referring now to FIGS. 1–4, the most preferred embodiment of the present invention is shown. Turning to FIGS. 1 and 4, the jewelry holder 10 includes a base 20 in the form of an open box having a top 22 opposite and spaced from a bottom 24, a first side 26 joining the top and bottom and a second side 28 opposite the first side and also joining the top and bottom. The box also includes an open front 30 and a rear 32 opposite the front and substantially normal to the first and second sides and joining the top with the bottom. In this most preferred embodiment, the open front slidably receives a drawer 40 which can be used to store jewelry and other objects.

Figure 5:
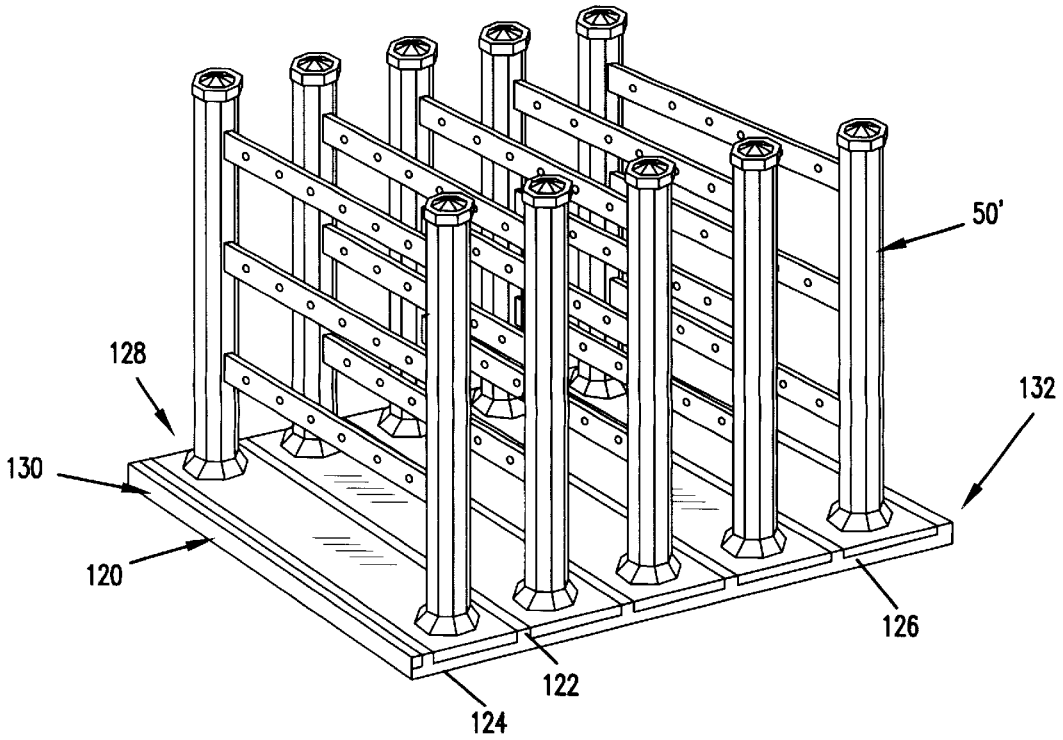
FIG. 5 is a perspective view of an alternative embodiment of the base, wherein the base is in the form of a slab.

In an alternative embodiment as best seen in FIG. 5, the base 120 is in the form of a slab having a top 122 and a bottom 124, a first side 126 and a second side 128 opposite the first side, and a front 130 and a tear 132 opposite the front and substantially normal to the first and second sides.

The base (20, 120) receives at least one stand 50 and, preferably a plurality of stands. Referring to FIGS. 1 and 4, it can be seen that the base includes at least one and, preferably a plurality of spaced apart grooves 34 that are sized to slidably receive a stand 50. The grooves 34 may slidably receive a stand 50 in either of two directions: from the side or from the top. The grooves 34 may extend at least a portion from either the first or second side to the opposite side. Alternatively, the grooves may extend at least a portion from either the front or the rear to the opposite end. Where more than one groove is provided, they are oriented parallel to each other. The grooves may be provided in any suitable manner and, as shown in FIG. 4 may be provided by orienting ridges 36 in a spaced apart fashion parallel to each other.

As best seen in FIGS. 1 and 2, each stand 50 includes a pair of spaced apart supports 52 connected by at least one and preferably by a plurality of crosspieces 56. In a preferred embodiment each crosspiece 56 has at least one and preferably a plurality of apertures 58 having a size suitable to receive a post or stem of an earring. Clip-on type earring of course can be clipped directly on the crosspiece. In this way an earring can be easily stored on the crosspiece 56. In the most preferred embodiment, each stand 50 includes a plurality of spaced apart parallel crosspieces 56 that are horizontally oriented to connect the supports. In the most preferred embodiment, each crosspiece 56 includes a plurality of spaced apart apertures 58 so that a number of earrings may be stored on each stand. Alternatively the crosspiece 56 need not have apertures in which case only clip-on type earring could be mounted on the crosspiece.

Figure 6:
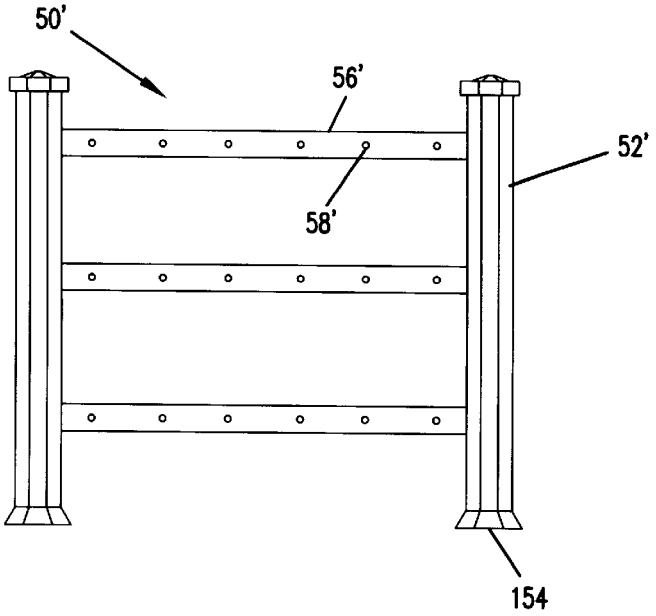
FIG. 6 is a front view of an alternative embodiment of a stand that may be used on a base having a plurality of depressions as well as on the base shown in FIGS. 2 and 5.

To permit simple and easy viewing access to stored earrings, the stands 50 are provided with a base 54 that is shaped and sized to permit slidable removal from the base 20 and, in particular, slidable removal from the grooves 36. In this way, when it is desired to store one or more earrings or to view and remove one or more earrings, the stand 50 may be slidably removed from the base (20, 120). The stand 50, when removed from the base (20, 120), is self-supporting. The stand 50 may be slidably removed in either of two directions: from the top or from the side. As shown in FIG. 2, the base 54 of the stand 50 may extend from one support 52 to the other and thus provide a more stable structure for the stand, especially when the stand is removed from the base (20, 120). Alternatively, as best seen in FIG. 6, the base 154 of the stand may simply be provided at the foot of each support. When the base 154 of the stand is provided in this manner (i.e, as shown in FIG. 6) it will be understood by one of skill in the art that the stand may be easily slidably located and removed from either of the bases as shown in FIGS. 4 and 5, as well as on a base wherein the top of the base has a plurality of depressions in a shape complementary to the shape of the base 154 so that the stand may be slidably positioned within the depressions.

In another embodiment, the base may be as shown in FIG. 5. In this embodiment, the base 120 is not in the form of a box with an open front but rather has a slab configuration. In yet another embodiment, the top of the base may have several grooves in the form of depressions wherein each depression can receive a complementary shaped base provided on the bottom of each support.

FIG. 3 is a cross-sectional view of a portion of the stand shown in FIG. 2 taken along line 3—3. FIG. 3 shows the dimension of an aperture formed in the crosspiece of the stand.

In a preferred embodiment, the stands and base are formed of a plastic, acrylic resin or a plastic consisting essentially of polymerized methyl methacrylate such as LUCITE™ or polystyrene.

Figure 7:
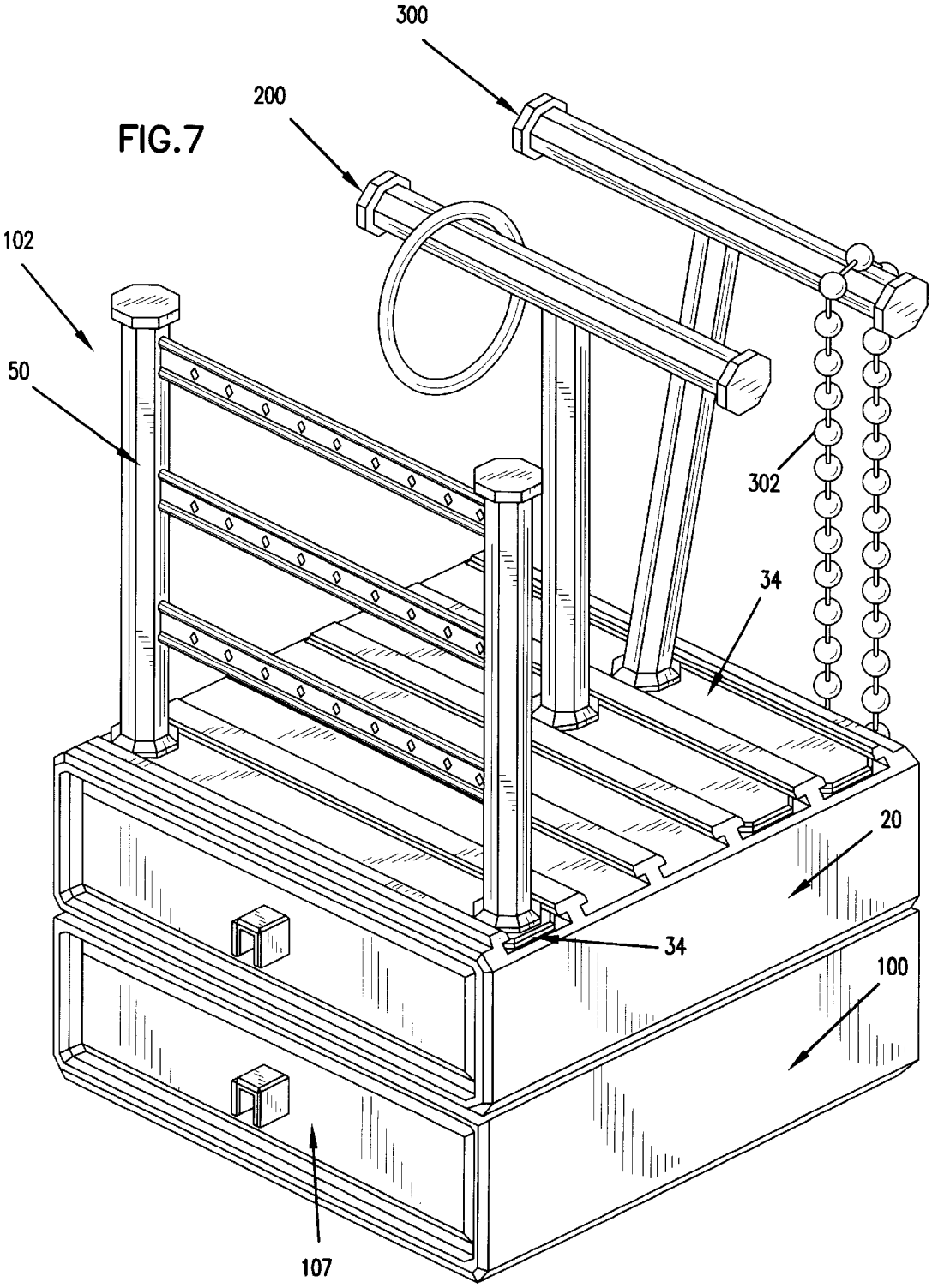
FIG. 7 is a perspective view of another preferred embodiment of a jewelry holder with a stackable base, a bracelet tree and a necklace tree.

FIG. 7 is a perspective view of another preferred embodiment of a jewelry holder with a stackable base, a bracelet tree and a necklace tree. The jewelry holder 102 includes a first base 20 and a second base 100 stackable underneath the first base 26. The first base 20 has grooves 34 as described in parent application Ser. No. 08/665,734, filed Jun. 14, 1996.

In addition to the earring stand 50 there is also provided a bracelet tree 200 and a necklace tree 300. Like the earring stand 50 the bracelet tree 200 and necklace tree 300 are slidably received in the same grooves 34 formed on the top surface of the base 20 as receives the earring stand 50. In a preferred embodiment the necklace tree 300 is positioned in the back most groove 34 on the base 20 and preferably is slightly tilted so that a longer necklace 302 can freely hang from the necklace tree 300 without touching the top surface of the base 20. Because the earring stand 50, bracelet tree 200 and necklace tree 300 are all slidably received in the grooves 34 they can be positioned in any groove 34 located on the top surface of the base 20. Thus these arrangements on the top surface of the base 20 can be varied and selected by the user. Also, because the earring stand 50, bracelet tree 200 and necklace tree 300 are interchangeable, the jewelry holder can be customized to a user's requirements by allowing the user to select how many earring stands 50, bracelet trees 200 and/or necklace trees 300 the user needs. So some user might need two earring stands 50, one bracelet tree 200 and two necklace trees 300, for example, while another user might select all earring stands 50. Of course a multitude of other options are available. In addition the top surface of the base 20 may have more or less grooves 34 than the particular embodiment illustrated.

Figure 8:
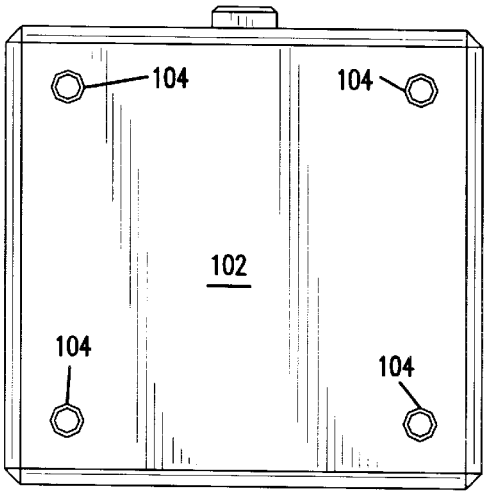
FIG. 8 is a bottom view of the first base shown in FIG. 7.
Figure 9:
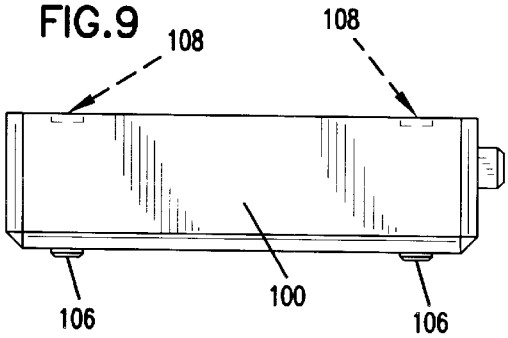
FIG. 9 is a side view of a second base shown in FIG. 7 according to a preferred embodiment of the present invention.

FIG. 8 is a bottom view of the first base 20 shown in FIG. 7. On the bottom surface 102 of the base 20 are preferably four mounting pegs 104 which in a preferred embodiment are short cylindrical-like legs. FIG. 9 is a side view of the second base 100 shown in FIG. 7 according to a preferred embodiment of the present invention. The second base 100 preferably also have four mounting pegs 106 on its underside and accommodates a drawer 107. Unlike the top surface of the first base 20, however, the top surface of the second base 100 does not have grooves for slidably receiving a plurality of stands. Instead, in a preferred embodiment depressions 108 are formed in the top surface of the second base 100. The depressions 108 are complementary in shape to the mounting pegs 104 on the underside of the first base 20 and are positioned to coincide with the mounting pegs 104 of the first base 20 when the first base 20 is mounted on the second base 100. Thus the first base 20 can be stacked on top of the second base 100 and the combination of the mounting pegs 104 on the bottom surface of the first base 20 and the depressions 108 on the top surface of the second base 100 keep the first base 20 from sliding off the second base 100. Alternatively, other features may be provided on the underside of the first base 20 and the top surface of the second base 100 to allow the two to be stacked together, such as slots and grooves, for example.

Alternatively, a base in the form of a slab (such as base 120 in FIG. 5 of the parent application U.S. Ser. No. 08/665,734 referred to above) may be provided with mounting pegs on its underside so that it can be mounted on a second base 100 if desired.

It will be appreciated that while only two bases are illustrated, the present invention is not limited to such an embodiment and more bases may be stacked underneath the second base 100.

Figure 10:
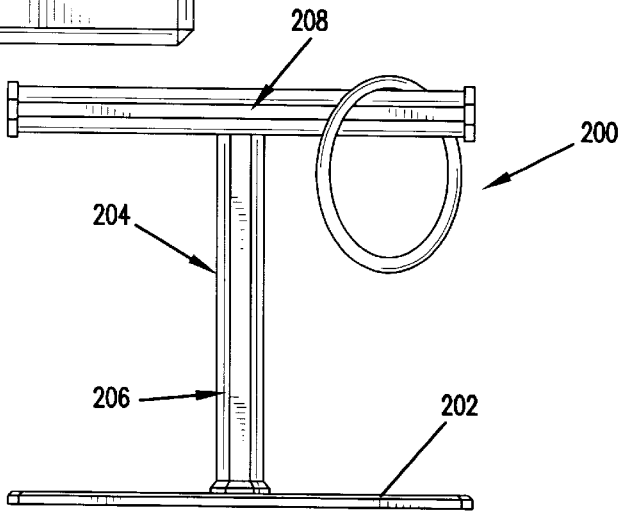
FIG. 10 is a front view of the bracelet tree shown in FIG. 7.

FIG. 10 is a front view of the bracelet tree 200 shown in FIG. 7. The bracelet tree 200 has a bottom member 202 that is slidably received in a groove 34 on the base 20 shown in FIG. 7. The bottom member 202 allows the bracelet tree 200 to be self-standing when removed from the base. The bracelet tree 200 has a T-shaped member 204 with a central, vertical trunk 206 and a cross bar 208 at the end of the trunk 206 on which bracelets can be mounted as shown. The cross bar 208 of the T-shaped member 204 may be cylindrical, as shown, or alternatively it may have a crescent moon shape or any other shape onto which bracelets may be mounted. In a preferred embodiment the bracelet tree 200 is formed as an integral unit.

Figure 11:
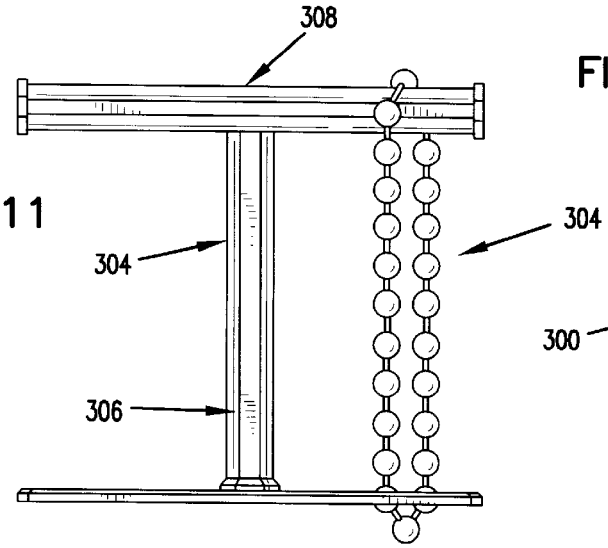
FIG. 11 is a front view of the necklace tree shown in FIG. 7.
Figure 12:
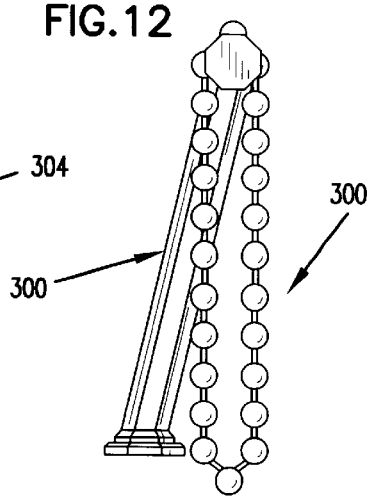
FIG. 12 is a side view of a necklace tree shown in FIG. 7.

FIG. 11 is a front view of the necklace tree 300 shown in FIG. 7. The necklace tree 300 is almost the same as the bracelet tree 200 shown in FIG. 10 except that its central, vertical trunk 306 is longer in length to accommodate the length of necklaces. In another preferred embodiment the trunk 306 may be tilted as shown in the side view shown in FIG. 12 so that when the necklace tree 300 is positioned at the back of the base, necklaces can hang freely without interfering with the top surface of the base as shown in FIG. 7.

In a preferred embodiment the necklace tree 300 and the bracelet tree 200 are formed of a plastic, acrylic resin or a plastic consisting essentially of polymerized methyl methacrylate such as LUCITE™ or polystyrene.

Figure 13:
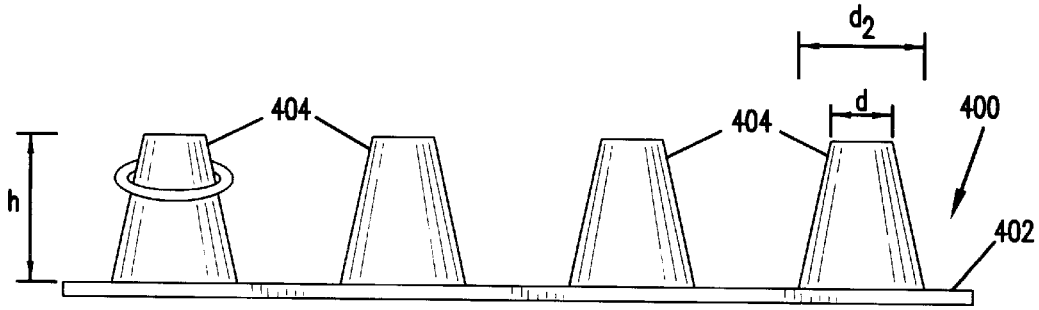
FIG. 13 is a front view of a ring holder platform according to a preferred embodiment of the present invention.
Figure 14:
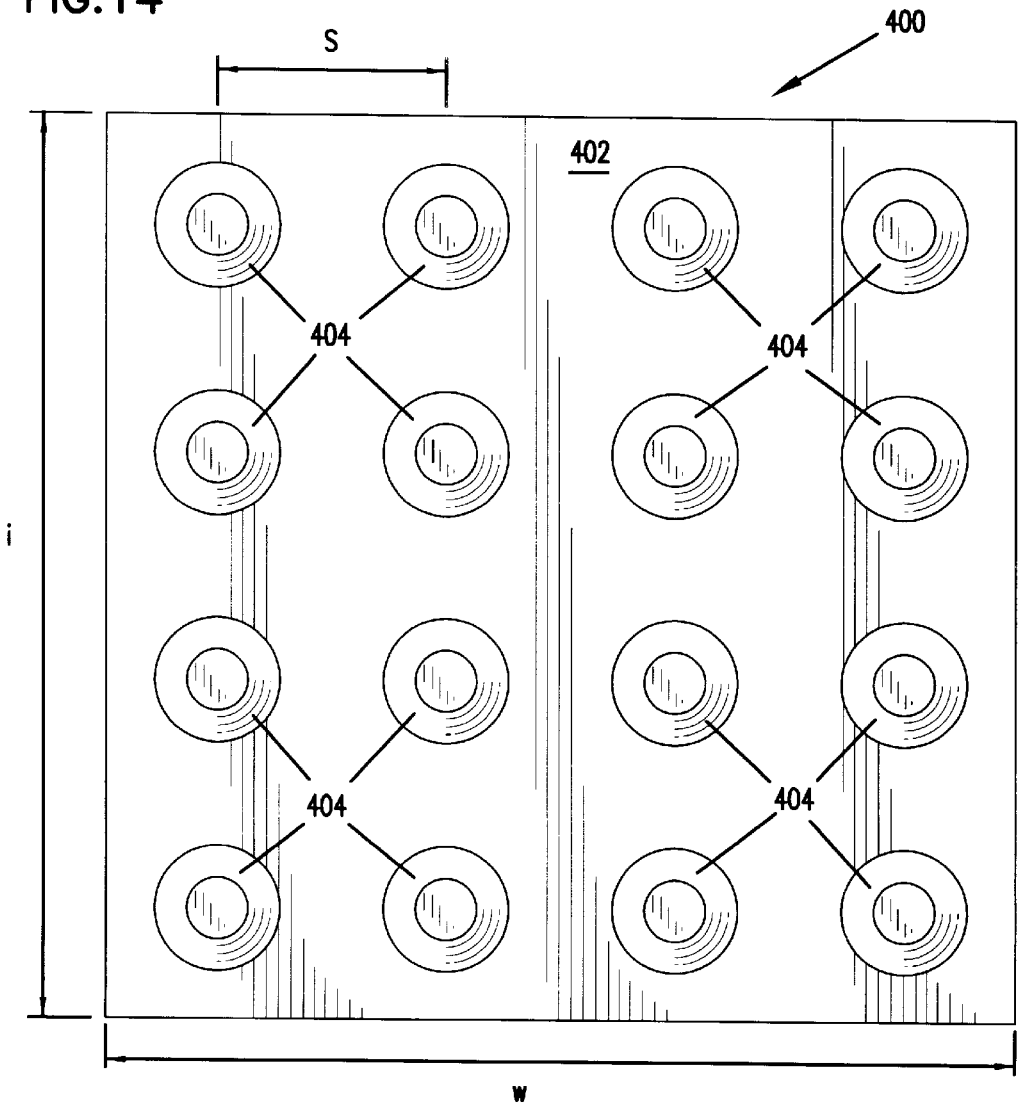
FIG. 14 is a top view of the ring holder platform shown in FIG. 13.

FIG. 13 is a front view of a ring holder platform 400 according to a preferred embodiment of the present invention. FIG. 14 is a top view of the ring holder platform 400 shown in FIG. 13. The ring holder platform 400 includes a substantially flat platform 402 on which are formed a plurality of mounds 404 that are preferably conical-like in shape. The mounds 404 are shaped to allow at least one ring to be mounted thereon as shown in FIG. 13. In a preferred embodiment four rows and four columns of mounds 404 are provided in a symmetrical fashion although other configurations are possible.

In a preferred embodiment, the platform 400 is rectangular in shape and has a length 1 of about 6 and $5/8^{th}$ inches and a width w of about 6 and ½ inches. The platform 400 is preferably about ¼ inch in thickness and the height h of the mounds is about 1 and $1/8^{th}$ inches from the top surface of the platform. The diameter d of the top of each mound 404 is about $7/16^{th}$ inches and the diameter $d_2$ of the bottom widest portion of mounds 404 is preferably about $1/8^{th}$ inches. The mounds 404 are preferably separated from immediately adjacent mounds by a distance s of about 1 and $5/8^{th}$ inches measured from the centers of the mounds 404.

In a preferred embodiment the ring holder platform 400 is formed of a molded plastic covered by a flock material. The ring holder platform can be inserted in a drawer of either the first or second bases shown in FIG. 7.

In another embodiment a plurality of stackable bases may be provided without any of the top surfaces of the bases having grooves to accommodate an earring stand, bracelet tree or necklace tree but instead may have at least one ring holder platform inserted in one of the drawers of a base.

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A jewelry holder comprising:

a first base having a first groove and a second groove, each groove having a groove height and a groove width, with said groove height being smaller than said groove width;

a first stand removably located on the base wherein the first stand has a "T" shaped member mounted on a first stand base which includes a base height and a base width, in which the base height is smaller than the base width and in which said base width substantially corresponds in size to either the first or second groove; and a second stand removably located on the base wherein the second stand has a base which includes a base height and a base width, in which the base height is smaller than the base width and in which said base width substantially corresponds in size to the either the first or second groove, wherein each base of each stand is slidably receivable in the either the first groove or the second groove.

2. A jewelry holder according to claim 1 wherein the T-shaped member has a height that is sufficient to hold at least one bracelet.

3. A jewelry holder according to claim 1 wherein the T-shaped member has a height that is sufficient to hold at least one necklace.

4. A jewelry holder according to claim 1 wherein the second stand has a pair of spaced apart vertical supports joined by at least one crosspiece wherein earrings can be mounted on the crosspiece.

5. A jewelry holder according to claim 4 wherein the at least one crosspiece has at least a pair of apertures for holding pierced-type earrings.

6. A jewelry holder comprising:

a first base wherein the first base is a box that includes a box top spaced from a bottom, a first side wall opposite and spaced from a second side wall each of the first and second side walls joining the box top and bottom, and a rear wall substantially normal to the first and second side walls wherein said box top, bottom, first and second side walls and rear wall define an opening opposite the rear wall for slidably receiving a drawer and where in said box top has a first groove and a second groove, each groove having a groove height and a groove width, with said groove height being smaller than said groove width;

a first stand removably located on the base wherein the first stand has a base which includes a base height and a base width, in which the base height is smaller than the base width and in which said base width substantially corresponds in size to either the first or second groove; and a second stand removably located on the base wherein the second stand has a base which includes a base height and a base width, in which the base height is smaller than the base width and in which said base width substantially corresponds in size to the either the first or second groove, wherein each base of each stand is slidably receivable in the either the first groove or the second groove.

7. A jewelry holder according to claim 6 further comprising a second base stackable underneath the first base wherein the second base is a box that includes a box top spaced from a bottom, a first side wall opposite and spaced from a second side wall each of the first and second side walls joining the box top and bottom, and a rear wall substantially normal to the first and second side walls wherein the box top, bottom, first and second side walls and the rear wall define an opening opposite the rear wall for slidably receiving a drawer.

8. A jewelry holder according to claim 6 further comprising a drawer slidably receivable in the opening of the first base; and a platform having a shape that fits inside the drawer wherein the platform has a plurality of mounds for holding rings thereon.

9. A jewelry holder according to claim 8 wherein the plurality of mounds are symmetrically arranged on the platform.

10. A jewelry holder according to claim 8 wherein the platform and plurality of mounds are formed of a molded plastic.

11. A jewelry holder comprising:

a. a box having i. a top spaced from a bottom, the top having a first and a second groove to slidably receive a first and a second stand, respectively, wherein each groove has a groove height and a groove width, the groove height being smaller than the groove width;

ii. a first side wall opposite and spaced from a second side wall and a rear wall substantially normal to the first and second side walls wherein said top, bottom, first side wall, second side wall and rear wall define an opening opposite the rear wall for slidably receiving a drawer; and b. a first stand removably located on the top wherein the first stand has a first stand base which includes a base height and a base width, in which the base height is smaller than the base width and in which the base width substantially corresponds in size to the first groove; and c. a second stand removably located on the top wherein the second stand has a second stand base which includes a base height and a base width, in which the base height is smaller than the base width and in which the base width substantially corresponds in size to the first groove, wherein the first and second base stands are slidably receivable in the first groove and the second groove, respectively.

12. A jewelry holder according to claim 11 wherein the first stand has a "T" shaped member mounted on the first stand base.

13. A jewelry holder according to claim 12 wherein the T-shaped member has a height that is sufficient to hold at least one bracelet.

14. A jewelry holder according to claim 12 wherein the T-shaped member has a height that is sufficient to hold at least one necklace.

15. A jewelry holder according to claim 12 wherein the second stand has a pair of spaced apart vertical supports joined by at least one crosspiece wherein earrings can be mounted on the crosspiece.

16. A jewelry holder according to claim 15 wherein the at least one crosspiece has at least a pair of apertures for holding pierced-type earrings.

17. A jewelry holder according to claim 11 further comprising a second base stackable underneath the first base wherein the second base is a box that includes a top spaced from a bottom, a first side wall opposite and spaced apart from a second side wall each of the first and second side walls joining the top and bottom, and a rear wall substantially normal to the first and second side walls wherein the top, bottom, first and second side walls and rear wall define an opening opposite the rear wall for slidably receiving a drawer.

18. A jewelry holder according to claim 11 further comprising:

a drawer slidably receivable in the opening defined by the top, bottom, first and second side walls and rear wall; and a platform having a shape that fits inside the drawer wherein the platform has a plurality of mounds for holding rings thereon.

19. A jewelry holder according to claim 11 further comprising a third groove in the top and a third stand removably located on the top wherein the third stand has a third stand base which includes a base height and a base width, in which the base height is smaller than the base width and in which said base width substantially corresponds in size to the third groove, wherein the third stand base is receivable in the third groove.

20. A jewelry holder according to claim 18 wherein the plurality of mounds are symmetrically arranged on the platform.

21. A jewelry holder according to claim 18 wherein the platform and plurality of mounds are formed of a molded plastic.

22. A jewelry holder comprising:

a first base having a first groove and a second groove, each groove having a groove height and a groove width, with said groove height being smaller than said groove width;

a first stand removably located on the base wherein the first stand has a base which includes a base height and a base width, in which the base height is smaller than the base width and in which said base width substantially corresponds in size to either the first or second groove and a pair of spaced apart vertical supports joined by at least one crosspiece wherein earrings can be mounted on the crosspiece; and a second stand removably located on the base wherein the second stand has a base which includes a base height and a base width, in which the base height is smaller than the base width and in which said base width substantially corresponds in size to the either the first or second groove, wherein each base of each stand is slidably receivable in the either the first groove or the second groove.

23. A jewelry holder according to claim 11 wherein the second stand has a pair of spaced apart vertical supports joined by at least one crosspiece wherein earrings can be mounted on the crosspiece.

24. A jewelry organizing system comprising:

a first base having a first groove and a second groove, each groove having a groove height and a groove width, with said height being smaller than said width;

a first stand removably located on the base wherein the first stand has a first stand base which includes a base height and a base width, in which the base height is smaller than the base width and in which said base width substantially corresponds in size to the first groove; and a second stand removably located on the base wherein the second stand has a second stand base which includes a base height and a base width, in which the base height is smaller than the base width and in which said base width substantially corresponds in size to the second groove, wherein the first and second base stands are slidably receivable in the first groove and the second groove, respectively; and at least on one piece of jewelry placed on the either the first or second stand.

25. The jewelry organizing system according to claim 24, wherein the first stand has a "T" shaped member mounted on the first stand base.

26. The jewelry organizing system according to claim 24 wherein the second stand as a pair of spaced apart vertical supports joined by at least one crosspiece wherein earrings can be mounted on said crosspiece.

27. A jewelry organizing system according to claim 24 wherein the first base is a box that includes a top spaced from a bottom, a first side wall opposite and spaced from a second side wall each of the first and second side walls joining the top and bottom, and a rear wall substantially normal to the first and second side walls wherein the top, bottom, first and second side walls and rear wall define an opening for slidably receiving a drawer.

28. A jewelry organizing system according to claim 27 further comprising a second base stackable underneath the first base wherein the second base is a box that includes a top spaced from a bottom, a first side wall opposite and spaced from a second side wall each of the first and second side walls joining the top and bottom, and a rear wall substantially normal to the first and second side walls wherein the top, bottom, first and second side wall and the rear wall define an opening for slidably receiving a drawer.

29. A jewelry holder according to claim 27 further comprising:

a drawer slidably received in the opening of the first base; and a platform insertable in the drawer wherein the platform has a plurality of mounds for holding rings thereon.

30. A jewelry organizing system according to claim 24 further comprising a third groove in the base and a third stand removably located on the base wherein the third stand has a third stand base which includes a base height and a base width, in which the base height is smaller than the base width and in which said base width substantially corresponds in size to the third groove, wherein the base of the third stand is slidably receivable in the third groove.

31. A method for organizing jewelry comprising:

providing a jewelry organizing system that comprises:

a. a first base having a first groove and a second groove, each groove having a groove height and a groove width, with said height being smaller than said width;

b. a first stand removably located on the base wherein the first stand has a first stand base which includes a base height and a base width, in which the base height is smaller than the base width and in which said base width substantially corresponds in size to either the first or second groove; and c. a second stand removably located on the base wherein the second stand has a second stand base which includes a base height and a base width, in which the base height is smaller than the base width and in which said base width substantially corresponds in size to either the first or second groove, wherein the first and second base stands are slidably receivable in either the first groove or the second groove; and placing at least one piece of jewelry on the first or second stand.

32. A method for organizing jewelry comprising:

providing a jewelry organizing system that comprises a. a first base having a first groove and a second groove, each groove having a groove height and a groove width, with said height being smaller than said width;

b. a first stand removably located on the first base wherein the first stand has a non-dovetailed top and a first stand base opposite said top which includes a base height and a base width, in which the base height is smaller than the base width and in which said base width substantially corresponds in size to either the first or second groove; and c. a second stand removably located on the base wherein the second stand has a second stand base which includes a base height and a base width, in which the base height is smaller than the base width and in which said base width substantially corresponds in size to either the first or second groove, wherein the first and second stand bases are slidably receivable in either the first groove or the second groove; and placing at least one piece of jewelry on the first or second stand.

33. The method of organizing jewelry according to claim 32 further comprising removing the first or second stand from the base.

34. The method of organizing jewelry according to claim 33 further comprising supporting the removed stand on a surface.

35. A jewelry holder comprising:

a first base having a first groove and a second groove, each groove having a groove height and a groove width, with said height being smaller than said width;

a first stand removably located on the first base wherein the first stand has a first stand base having a T-shaped member mounted thereon, said first stand base further includes a base height and a base width, in which the base height is smaller than the base width and in which said base width substantially corresponds in size to the first second groove; and a second stand removably located on the base wherein the second stand has a second stand base attached to said bottom which includes a base height and a base width, in which the base height is smaller than the base width and in which said base width substantially corresponds in size to the second groove, wherein the first and second stand bases are slidably receivable in the first groove and the second groove, respectively.

36. A jewelry holder according to claim 35 wherein the T-shaped member has a height that is sufficient to hold at least one bracelet.

37. A jewelry holder according to claim 35 wherein the T-shaped member has a height that is sufficient to hold at least one necklace.

38. A jewelry holder according to claim 35 wherein the second stand has a pair of spaced apart vertical supports joined by at least one crosspiece wherein earrings can be mounted on the crosspiece.

39. A jewelry holder according to claim 38 wherein the at least one crosspiece has at least a pair of apertures for holding pierced-type earrings.

40. A jewelry holder according to claim 35 wherein the first base is a box that includes a top spaced from a bottom, a first side wall opposite and spaced from a second side wall each of the first and second side walls joining the top and bottom, and a rear wall substantially normal to the first and second side walls wherein the top, bottom, first and second side walls, and rear wall define an opening for slidably receiving a drawer.

41. A jewelry holder according to claim 40 further comprising a second base stackable underneath the first base wherein the second base is a box that includes a top spaced from a bottom, a first side wall opposite and spaced from a second side wall each of the first and second side walls joining the top and bottom and a rear wall substantially normal to the first and second side walls wherein the top, bottom, first and second side walls and rear wall define an opening for slidably receiving a drawer.

42. A jewelry holder according to claim 40 further comprising a drawer slidably receivable in the opening of the first base; and a platform insertable in the drawer wherein the platform has a plurality of mounds for holding rings thereon.

43. A jewelry holder according to claim 35 further comprising a third groove in the base and a third stand removably located on the base wherein the third stand has a third stand base which includes a base height and a base width, in which the base height is smaller than the base width and in which said base width substantially corresponds in size to the third groove, wherein the third stand base is slidably receivable in the third groove.

44. A jewelry holder according to claim 42 wherein the plurality of mounds are symmetrically arranged on the platform.

45. A jewelry holder according to claim 42 wherein the platform and plurality of mounds are formed of molded plastic.

46. The jewelry organizing system according to claim 25 wherein the second stand as a pair of spaced apart vertical supports joined by at least one crosspiece wherein earrings can be mounted on said crosspiece.

* * * * *